US009687750B2

(12) United States Patent
Rossi et al.

(10) Patent No.: US 9,687,750 B2
(45) Date of Patent: Jun. 27, 2017

(54) PIVOTING DISC LAUNCHING TOY

(71) Applicant: Mattel, Inc., El Segundo, CA (US)

(72) Inventors: John R. Rossi, West Hollywood, CA (US); Wei Bin Xie, Shenzhen (CN)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/875,639

(22) Filed: Oct. 5, 2015

(65) Prior Publication Data

US 2016/0096118 A1 Apr. 7, 2016

Related U.S. Application Data

(60) Provisional application No. 62/060,039, filed on Oct. 6, 2014.

(51) Int. Cl.
*A63H 33/18* (2006.01)
*F41B 7/08* (2006.01)

(52) U.S. Cl.
CPC ..... *A63H 33/18* (2013.01); *F41B 7/08* (2013.01)

(58) Field of Classification Search
CPC ..... F41J 9/30; F41J 9/18; F41B 7/08; F16H 25/12; F16H 25/122; A63H 33/18
See application file for complete search history.

(56) References Cited

U.S. PATENT DOCUMENTS 336,535 A 2/1886 Voigt
379,913 A 3/1888 Stockton
496,539 A 5/1893 Reinert
624,980 A 10/1899 Heyer
778,046 A 12/1904 Kjellman
855,949 A 6/1907 Hoffman
867,226 A 10/1907 Allen
1,463,894 A 8/1923 Jaffe
1,998,268 A 4/1935 Brown
2,195,838 A 4/1940 Gadke
2,601,070 A 6/1952 Teschel et al.
2,735,221 A * 2/1956 Fields ..... A63H 17/006 124/29
3,183,903 A 5/1965 Thompson
3,581,434 A 6/1971 Fels
3,895,459 A 7/1975 Morrison et al.
4,165,580 A 8/1979 Miura et al.
4,170,215 A 10/1979 Kettlestrings
4,248,202 A 2/1981 Jaworski et al.
4,277,068 A 7/1981 Sasaki
4,321,906 A 3/1982 Thornell
4,976,249 A 12/1990 Gagnon
(Continued)

*Primary Examiner* — John E Simms, Jr.
(74) *Attorney, Agent, or Firm* — Sheppard, Mullin, Richter & Hampton LLP

(57) ABSTRACT

A disc launching toy is disclosed comprising a main body and arms connected to the body. When one or both of the arms are pulled outwardly from the body, the body pivots upward. A disc launcher aperture is located at the bottom side of the body, such that when one or more of the arms are pulled outwardly from the body and the body pivots upward, the aperture swings up towards a generally horizontal presentation. Once the aperture reaches a substantially horizontal orientation, continued pulling of the arms causes the disc launcher to fire a disc, such that both the pivoting of the body and the launching of a disc result from a single, substantially continuous movement.

20 Claims, 11 Drawing Sheets

(56) References Cited

U.S. PATENT DOCUMENTS

| | | | | |
|---|---|---|---|---|
| 5,050,575 | A | 9/1991 | Killion | |
| 5,052,973 | A | 10/1991 | Rudell et al. | |
| 5,199,410 | A | 4/1993 | Cheng | |
| 5,334,079 | A | 8/1994 | Gentile et al. | |
| 5,370,571 | A | 12/1994 | Bosch | |
| 5,433,641 | A | 7/1995 | Rudell et al. | |
| 5,471,967 | A | 12/1995 | Matsuzaki et al. | |
| 5,611,322 | A | 3/1997 | Matsuzaki et al. | |
| 5,613,482 | A | 3/1997 | Thai et al. | |
| 5,711,285 | A | 1/1998 | Stewart et al. | |
| 5,857,451 | A | 1/1999 | Ciluffo et al. | |
| 5,897,417 | A | 4/1999 | Grey | |
| 5,996,564 | A * | 12/1999 | Kotowski | F41B 4/00 124/6 |
| 6,116,229 | A | 9/2000 | Wu | |
| 7,108,576 | B2 | 9/2006 | LaPointe | |
| 7,263,986 | B2 | 9/2007 | Lovell | |
| 7,461,645 | B2 | 12/2008 | Williamson et al. | |
| D608,400 | S | 1/2010 | Ryaa | |
| 7,673,624 | B2 | 3/2010 | Rosella | |
| 7,731,061 | B1 | 6/2010 | Woodhouse et al. | |
| 8,118,637 | B2 | 2/2012 | De La Torre | |
| 8,893,699 | B2 | 11/2014 | Bird et al. | |
| 8,997,727 | B1 * | 4/2015 | Hamel | F41B 7/08 124/10 |
| 2009/0071455 | A1 * | 3/2009 | Sopinsky | A63F 9/02 124/1 |
| 2011/0244756 | A1 | 10/2011 | Christoffel | |
| 2012/0138034 | A1 * | 6/2012 | Whidborne | F41J 9/30 124/8 |
| 2012/0178338 | A1 | 7/2012 | Mowbray | |
| 2013/0109270 | A1 | 5/2013 | Martinez et al. | |
| 2013/0252503 | A1 | 9/2013 | Kwok et al. | |
| 2014/0090630 | A1 * | 4/2014 | Bird | F41B 7/08 124/31 |
| 2015/0226514 | A1 | 8/2015 | Bird et al. | |

* cited by examiner

PIVOTING DISC LAUNCHING TOY

CROSS-REFERENCE TO RELATED APPLICATIONS

The present application claims priority to U.S. Provisional Application No. 62/060,039, filed Oct. 6, 2014, the entire contents of which are incorporated by reference as if fully set forth herein.

FIELD OF THE INVENTION

The present invention relates to disc launching toys, and more particularly to a toy disc launcher that both pivots a launcher body and triggers launching of a disc from the launcher body in a substantially continuous movement.

BACKGROUND

Toys for launching objects are popular with children. Such toys typically involve loading an object into a launch mechanism of the toy, and whether by actuating a trigger or some other device, the object is released or otherwise projected from the toy.

While toy launchers have been popular for many years, new and unique ways of firing projectiles continually evolve in order to provide amusement and recreational play for children and adults alike.

BRIEF SUMMARY

Disclosed is a disc launching toy comprising a main body and arms connected to the body. When one or both of the arms are pulled outwardly from the body, the body pivots upward. A disc launcher aperture is located at the bottom side of the body, such that when one or more of the arms are pulled outwardly from the body and the body pivots upward, the aperture swings up towards a generally horizontal presentation. Once the aperture reaches a substantially horizontal orientation, continued pulling of the arms causes the disc launcher to fire a disc, such that both the pivoting of the body and the launching of a disc result from a substantially continuous movement.

In one embodiment, a toy projectile launcher is provided. The toy projectile launcher comprises a body and a launch actuator. The launch actuator is extendable from and pivotably mounted to the body and operatively engages a projectile launcher within the body. The toy projectile launcher is configured such that activating the launch actuator causes pivoting of the body with respect to the launch actuator and activation of the projectile launcher to launch a projectile from the body.

The toy projectile launcher can further comprise a projectile cartridge configured to receive a plurality of projectiles in the projectile cartridge. Activation of the launch actuator can cause one of the plurality of projectiles to be launched from the body.

The toy projectile launcher can further comprise a first arm extendable from a first side of the body and a second arm extendable from a second side of the body. A mechanical controller mechanically connecting the first arm and the second arm to the body and to the projectile launcher within the body can further be provided. The mechanical controller can comprise a carrier shaft and a drive mechanism attached to each of the first arm and the second arm and engaging the carrier shaft.

The first arm and the second arm can be extendable from the body by a pull stroke of fixed length, wherein the mechanical controller is configured to translate a first portion of the pull stroke through the drive mechanism to the carrier shaft to pivot the body with respect to the first arm and the second arm.

The mechanical controller can further be configured to translate a second portion of the pull stroke through the drive mechanism to the projectile launcher to launch a projectile from the body.

The mechanical controller can further be configured to translate reversal of the second portion of the pull stroke through the drive mechanism to the projectile launcher to reset the projectile launcher for launching additional projectiles.

The drive mechanism can further comprise a first drive shaft attached to the first arm and a second drive shaft attached to the second arm, and at least one guide pin attached to each of the first drive shaft and the second drive shaft.

The carrier shaft can further comprise a plurality of guide channels. Each of the guide channels can receive one of the guide pins.

In another embodiment, a toy projectile launcher is provided. The toy projectile comprises a body configured to receive a plurality of projectiles and a launch actuator operatively engaging a projectile launcher within the body. The launch actuator further comprises a first arm extendable from a first side of the body and a second arm extendable from a second side of the body. The extension of the first and second arms away from the body causes activation of the projectile launcher to launch a projectile from the body.

Extension of the first and second arms away from the body further can cause the body to pivot with respect to the first and second arms.

The body can further comprise a projectile cartridge configured to receive a plurality of projectiles in the projectile cartridge such that activation of the launch actuator causes one of the plurality of projectiles to be launched from the body.

The toy projectile launcher can further comprise a mechanical controller mechanically connecting the first arm and the second arm to the body and to the projectile launcher within the body. The mechanical controller can comprise a carrier shaft and a drive mechanism attached to each of the first arm and the second arm and engaging the carrier shaft.

The first arm and the second arm can be extendable from the body by a pull stroke of fixed length, wherein the mechanical controller is configured to translate a first portion of the pull stroke through the drive mechanism to the carrier shaft to pivot the body with respect to the first arm and the second arm.

The mechanical controller can further be configured to translate a second portion of the pull stroke through the drive mechanism to the projectile launcher to launch a projectile from the body.

The mechanical controller can further be configured to translate reversal of the second portion of the pull stroke through the drive mechanism to the projectile launcher to reset the projectile launcher for launching additional projectiles.

The drive mechanism can further comprise a first drive shaft attached to the first arm and a second drive shaft attached to the second arm, and at least one guide pin attached to each of the first drive shaft and the second drive shaft.

The carrier shaft can further comprise a plurality of guide channels, each of the guide channels receiving one of the guide pins.

In a further embodiment, a toy projectile launcher is provided. The toy projectile launcher comprises a body comprising a projectile launcher and a carrier shaft and a drive shaft movably disposed within the carrier shaft. The drive shaft comprises guide pins engaging the carrier shaft such that axial movement of the drive shaft in a first direction relative to the carrier shaft causes guide pins to traverse one or both of an arc length and an axial length of the carrier shaft. When the guide pins traverse the arc length of the carrier shaft, the guide pins cause the body to rotate a predetermined angle relative to the drive shaft from a first position to a second position. When the guide pins traverse the axial length of the carrier shaft with the body in the second position, the guide pins activate the projectile launcher.

The drive shaft can comprise two portions such that the axial movement of the drive shaft in the first direction entails moving the two portions in opposing directions away from one another.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Preferred and non-limiting embodiments of the inventions may be more readily understood by referring to the accompanying drawings in which.

Like numerals refer to like parts throughout the several views of the drawings.

DETAILED DESCRIPTION OF THE PREFERRED EMBODIMENTS

Specific, non-limiting embodiments of the present invention will now be described with reference to the drawings. It should be understood that such embodiments are by way of example only and merely illustrative of but a small number of embodiments within the scope of the present invention. Various changes and modifications obvious to one skilled in the art to which the present invention pertains are deemed to be within the spirit, scope and contemplation of the present invention as further defined in the appended claims.

Figure 1A:
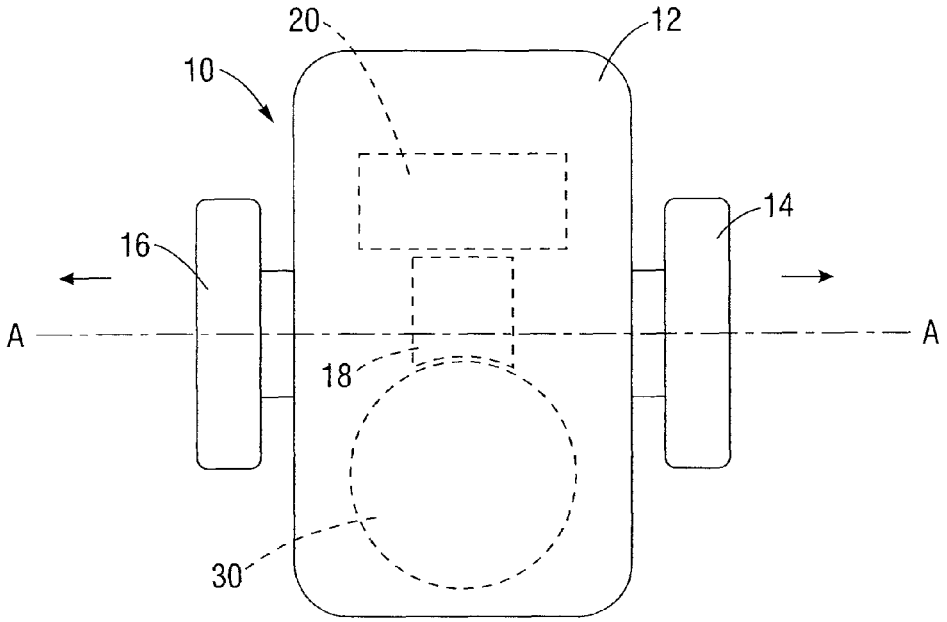
FIG. 1A provides a front schematic view of a toy projectile launcher in a first position in accordance with certain aspects of one embodiment of the invention.
Figure 1B:
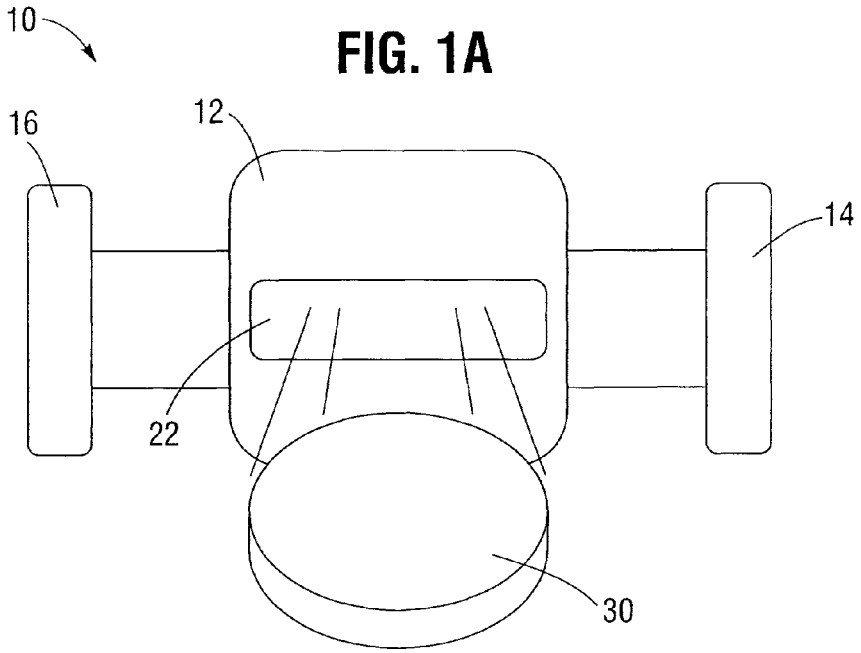
FIG. 1B provides a front schematic view of the toy projectile launcher of FIG. 1A moved into a launch position.

FIGS. 1A and 1B depict certain aspects of an embodiment of a toy disc launcher 10. The toy disc launcher 10 is depicted as comprising a main body 12, a flying disc launcher 18 configured to launch flying discs 30 from toy disc launcher 10, and a launch actuator comprising a first arm 14 and a second arm 16 for activating the flying disc launcher. In other embodiments, only the first arm 14 may serve as a launch actuator. The first arm 14 is attached to and extendable from one side of main body 12, and the second arm 16 is attached to and extendable from another side of main body 12. The first arm 14 and the second arm 16 can be actuated between a first loading position, in which the first and second arms 14, 16 are positioned close to the main body 12 (FIG. 1A) and a second launch position, in which the first and second arms 14, 16 extend outwardly from the main body 12 (FIG. 1B), by pulling the first arm 14 and second arm 16 away from one another in the direction of the arrows indicated in FIG. 1A.

A mechanical controller 20 inside of main body 12 is configured to pivot the main body 12 about a pivot axis A-A from the first position as shown in FIG. 1A to a launch position as shown in FIG. 1B, and to simultaneously launch a projectile, such as a flying disc 30, through a launch opening 22 of main body 12. More particularly, when both of arms 14 and 16 are pulled outwardly from the main body 12, main body 12 pivots upwardly about axis A-A. Launch opening 22 is thus initially pointing downwardly (as viewed in FIG. 1A), such that when arms 14 and 16 are pulled outwardly from main body 12 (in the direction indicated by the arrows in FIG. 1A), main body 12 pivots upwardly about axis A-A and launch opening 22 swings up towards a substantially horizontal presentation. Once the launch opening 22 reaches a substantially horizontal orientation (as shown in FIG. 1B), continued pulling of arms 14 and 16 causes toy disc launcher 10 to launch a flying disc 30, thus providing a single, substantially continuous movement that both pivots main body 12 and initiates the launch of a flying disc 30 from toy disc launcher 10. While description may be made to a "disc", the system may be modified within the scope of these inventions to work with other shaped projectiles, such as spherical pellets or balls, etc.

Figure 2:
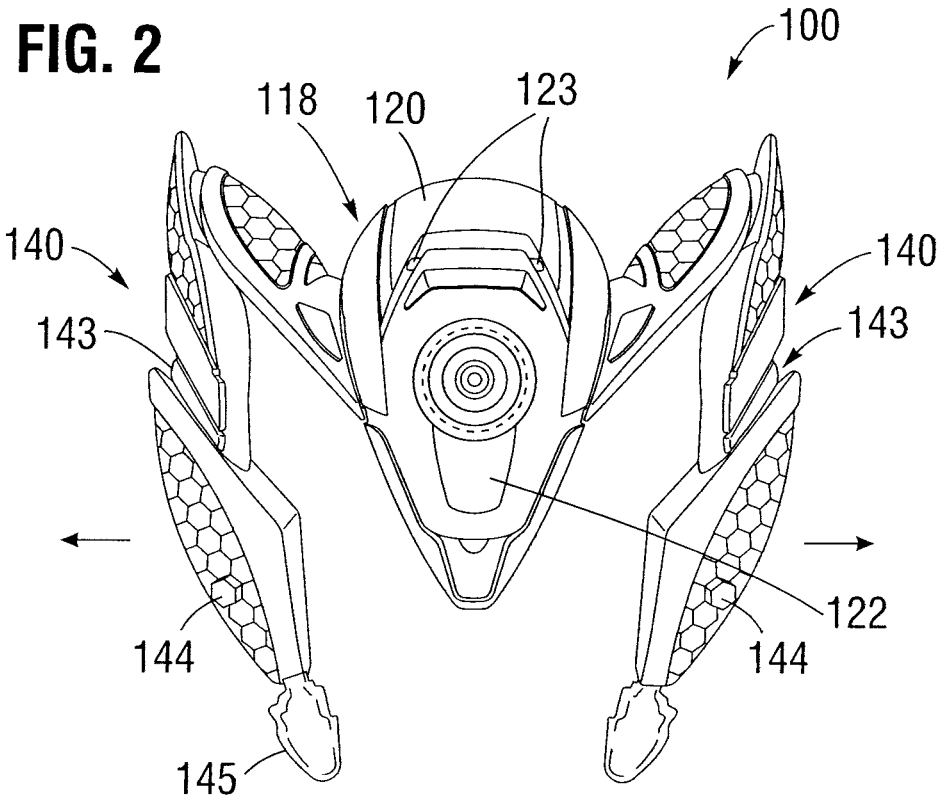
FIG. 2 is a front view of a toy projectile launcher in a first non-launch position in accordance with further aspects of an embodiment of the invention.
Figure 3:
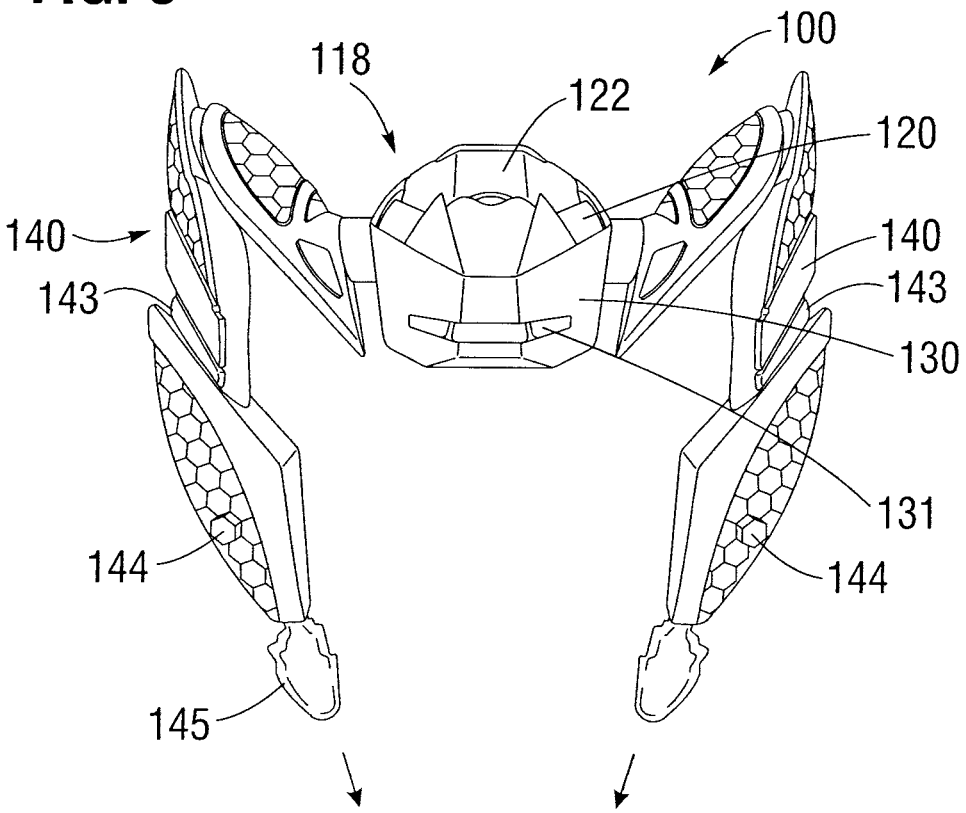
FIG. 3 is a front view of the toy projectile launcher of FIG. 2 moved into a launch position.

FIGS. 2 and 3 are front views of a toy disc launcher 100 in accordance with another embodiment. Toy disc launcher 100 has a main body (shown generally at 118) formed of an upper body portion 120 and a lower body portion 130, and arms 140 extending outwardly from opposite sides of the main body 118. FIG. 2 shows toy disc launcher 100 in a first, non-launch position in which arms 140 are immediately adjacent main body 118, and FIG. 3 shows toy disc launcher 100 in a second, altered, launch position in which arms 140 are pulled outwardly from main body 118 (in the direction indicated by the arrows in FIG. 2) with main body 118 having pivoted with respect to arms 140.

Figure 4:
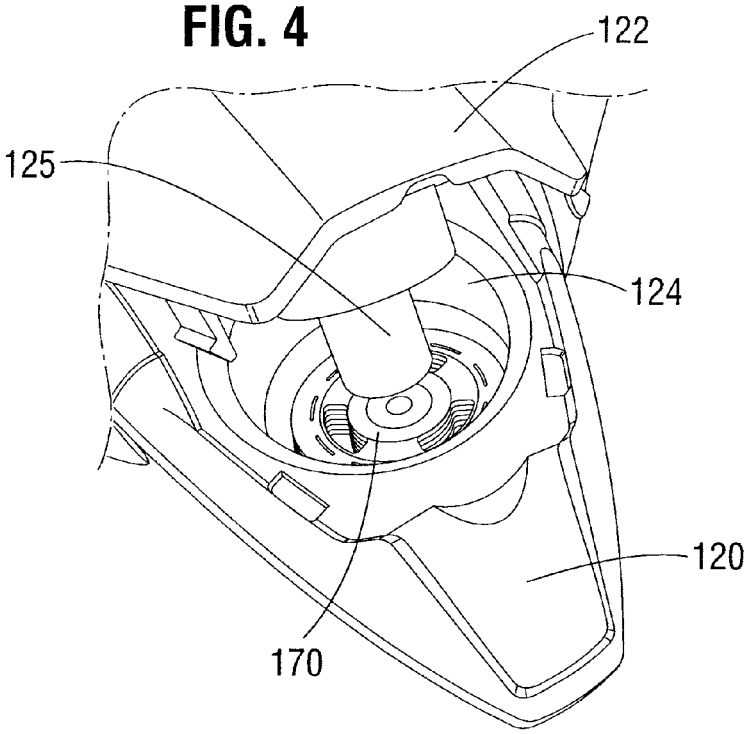
FIG. 4 is a close-up perspective view of a cartridge and spring-biased plunger of the toy projectile launcher of FIG. 2.

With reference to FIG. 2 and the close-up view of FIG. 4, upper body portion 120 has a cover hatch 122 connected to upper body portion 120 at hinges 123 (see FIG. 2). The cover hatch 122 extends over a disc cartridge 124 within the upper body portion 120 that is configured to hold multiple flying discs 170 stacked one atop the other that can be sequentially launched from the launcher 100, as will be discussed in further detail below. A spring-biased plunger 125 is mounted on a bottom side of cover hatch 122 over disc cartridge 124 and configured to push flying discs 170 down into a launch assembly for launch presentation when the cover hatch 122 is closed. The lower body portion 130 (see FIG. 3) includes a launch opening 131 through which flying discs 170 may be launched from the launch assembly within the main body 118 of disc launcher 100.

Figure 5:
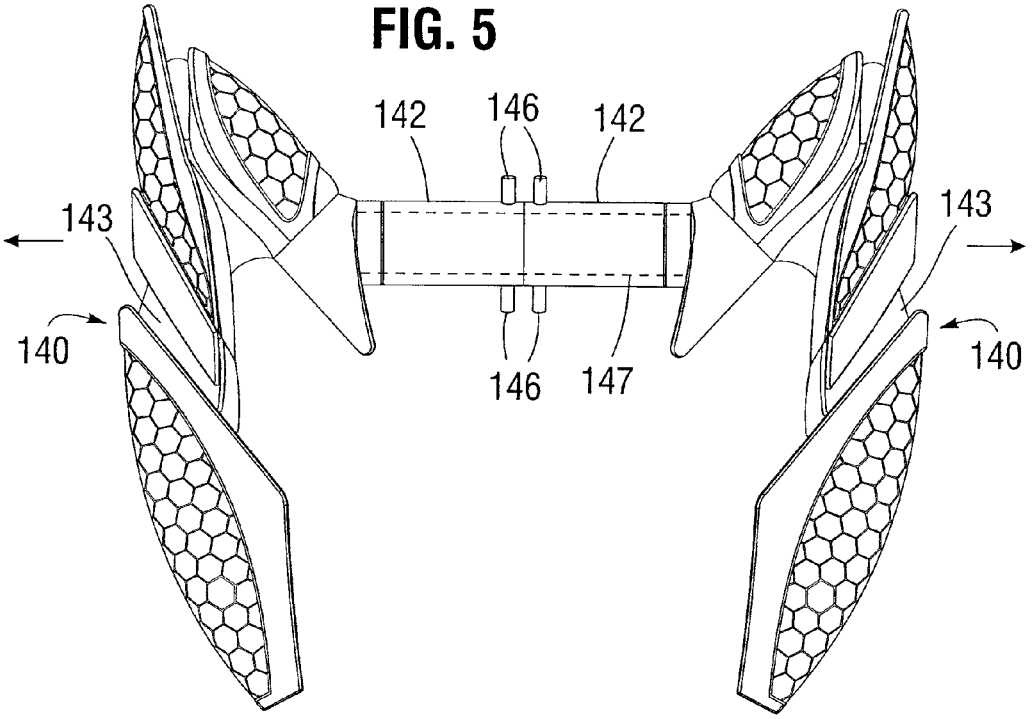
FIG. 5 is a rear view of the toy projectile launcher with the main body removed to show the arms and drive shafts of the toy projectile launcher of FIG. 2.

In FIG. 5, the arms 140 are shown mounted to drive shafts 142. The drive shafts 142 engage both a pivoting mechanism configured to pivot the main body 118 with respect to arms 140 and a launching mechanism configured to launch discs 170 from the main body 118 (not depicted) as the arms 140 are pulled outwardly in opposing directions in the direction of the arrows, typically away from the main body 118. In some embodiments, the arms 140 are extendable from the main body 118 by a pull stroke of a fixed length. A first portion of the pull stroke may pivot the main body 118 with respect to the arms 140, and a second portion of the pull stroke may cause internal launcher 160 to launch a projectile 170 from the main body 118 and out of the launch opening 131. As the arms 140 are retracted back towards the main body 118 and the second portion of the pull stroke is reversed, the internal launcher 160 is reset for launching additional projectiles 170.

In some embodiments, the arms 140 have articulable joints 143 allowing differing portions of arms 140 to pivot with respect to other portions of arms 140 and with respect to drive shafts 142. In the embodiments depicted in FIGS. 2 and 3, arms 140 further include spring-activated projectile launchers 144 configured to launch projectiles 145 out from the ends of arms 140. The pivoting of the portions of the arms 140 about the joints 143 allows a user to change or vary the aim the spring-activated projectile launchers 144 and launch projectiles 145 towards a desired target.

In use, a user may load a number of flying discs 170 into the disc cartridge 124 located underneath the cover hatch 122 and grasp disc launcher 100 by each arm 140. As the user pulls both of arms 140 outwardly and away from main body 118, main body 118 pivots about the drive shafts 142 approximately 90 degrees with respect to drive shafts 142. Other embodiments may pivot the body to different angles, depending on a desired function. After the main body 118 has pivoted to this new orientation, continued pulling of arms 140 outwardly and away from main body 118 causes an internal launcher 160, depicted in FIGS. 13 through 15, to launch a single flying disc 170 through launch opening 131 of lower body portion 130. The user may then push the arms 140 slightly back in toward main body 118 to cause the main body 118 to pivot to its original first position and reset the internal launcher 160. A disc feeder inside of upper body portion 120 automatically feeds the next flying disc into a disc receiver of the internal launcher 160. Thereafter, pulling the arms 140 outwardly and away from main body 118 again pivots the main body 118 to a second launch position and launches the next and subsequent disc 170.

Pivoting of main body 118 is accomplished by way of guide pins 146 on drive shafts 142 engaging guide channels 151 on internal carrier shaft 150 (which is coupled to main body 118), and launching of discs 170 is accomplished by guide pins 146 engaging the internal launcher 160 as discussed in greater detail below. As shown in FIG. 5, guide pins 146 extend outwardly from and are affixed to drive shafts 142. The drive shafts 142 are attached to each arm 140 on opposite sides of each drive shaft 142. An internal support rod 147 (shown in dashed lines in FIG. 5) is positioned within drive shafts 142 and preferably connects arms 140 to prevent their full detachment from one another. Thus, as arms 140 are pulled away from one another to cause main body 118 to pivot and to launch discs 170 from the internal launcher 160, drive shafts 142 slide along internal support rod 147. Likewise, as arms 140 are pulled away from one another, guide pins 146 likewise separate and thus are pulled away from one another.

Figure 6:
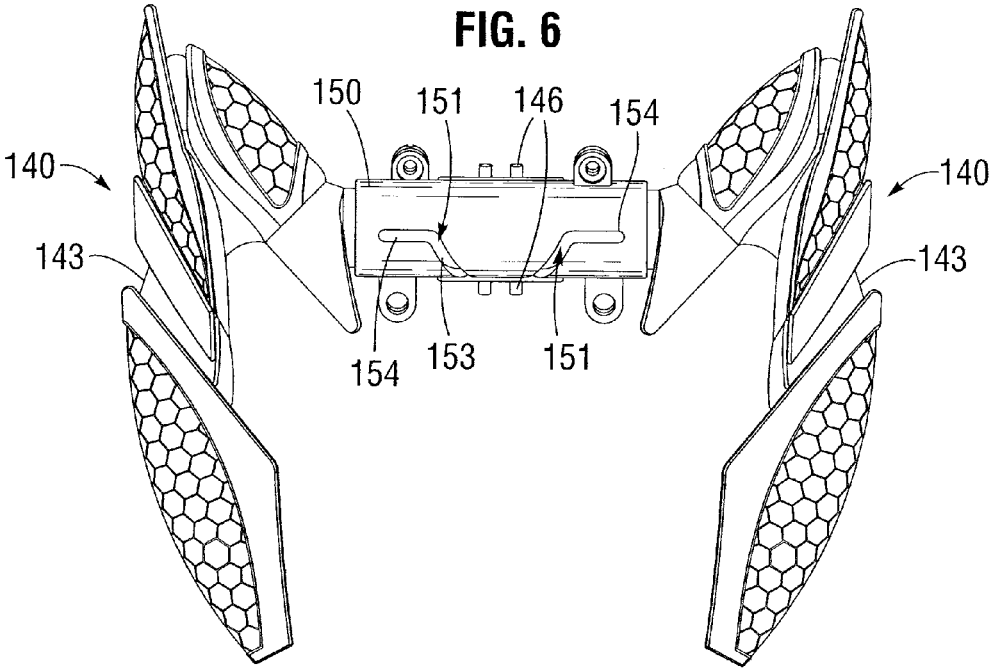
FIG. 6 is a rear view of arms and a carrier shaft of the toy projectile launcher of FIG. 2 without the main body.
Figure 7:
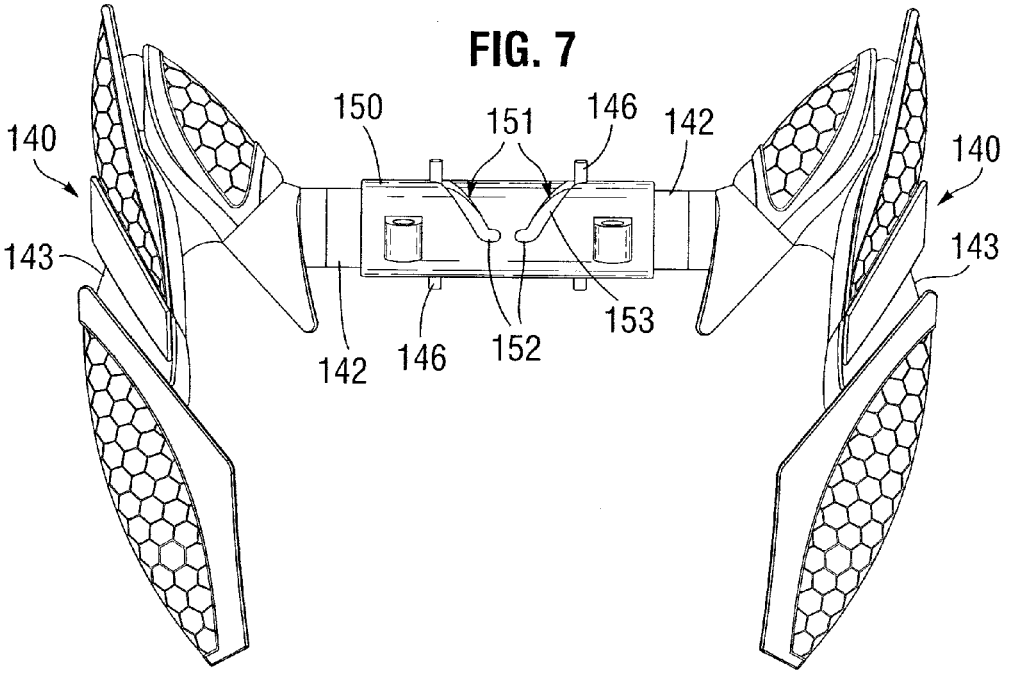
FIG. 7 is a rear view of the arms and carrier shaft of FIG. 2 in a launch position without the main body.

FIG. 6 shows a rear view of arms 140 and carrier shaft 150 of the toy disc launcher 100 in the first, non-launch position of FIG. 2. Guide pins 146 are shown in their inner-most positions, in which the guide pins 146 are separated from one another at a first distance. FIG. 7 shows a rear view of arms 140 and carrier shaft 150 of the toy disc launcher 100 in the launch position of FIG. 3. Guide pins 146 are shown in their outer-most position, in which the guide pins 146 are separated from one another at a second distance that is greater than the first distance. The outer housing of the main body 118 is removed from the view of FIGS. 6 and 7 to reveal the structure of the carrier shaft 150.

Guide pins 146 extend from drive shafts 142 through guide channels 151 of carrier shaft 150. In the illustrated embodiments, each of the top half of carrier shaft 150 and the bottom half of carrier shaft 150 is provided guide channels 151 of identical configuration. As shown in FIGS. 6 and 7, the right guide channel 151 is generally a slanted S-shaped curve, and the left guide channel 151 is a mirror image of the right guide channel 151. Guide pins 146 fit closely within each guide channel 151, but with sufficient clearance so as to allow guide pins 146 to travel through guide channels 151.

In the first, non-launch position of FIG. 6, guide pins 146 on drive shafts 142 are closest to one another and sit within an axially inner-most portion of each guide channel 152. As arms 140 are pulled apart, guide pins 146 travel a small distance through an inner axial portion 152 (best seen in FIG. 7) of each guide channel 151 as arms 140 extend outwardly from main body 118 without yet pivoting main body 118. Guide pins 146 then enter into angled portion 153, and as they move through angled portion 153, they cause carrier shaft 150 to rotate. Since carrier shaft 150 is affixed to main body 118, main body 118 likewise rotates as carrier shaft 150 rotates.

The carrier shaft 150 can be shaped as a cylinder, as depicted in the Figures, and the locations of the inner and outer axial portions 152, 154 can be selected to provide the desired degree of rotation of the main body 118 about the drive shaft 142. In the illustrated embodiments, each angled portion 153 of guide channels 151 extends around approximately 90 degrees of the circumference, such that as guide pins 146 travel between the inner axial portion 152 and outer axial portion 154, main body 118 likewise pivots with respect to arms 140 by approximately 90 degrees. Once guide pins 146 reach the outer axial end of each angled portion 153 of guide channels 151, guide pins 146 enter into outer axial portions 154 of guide channels 151, such that further pulling of arms 140 away from main body 118 no longer rotates main body 118 with respect to arms 140. Rather, further pulling of arms 140 away from main body 118 completes activation of the disc launch mechanism, as detailed further below.

Figure 8:
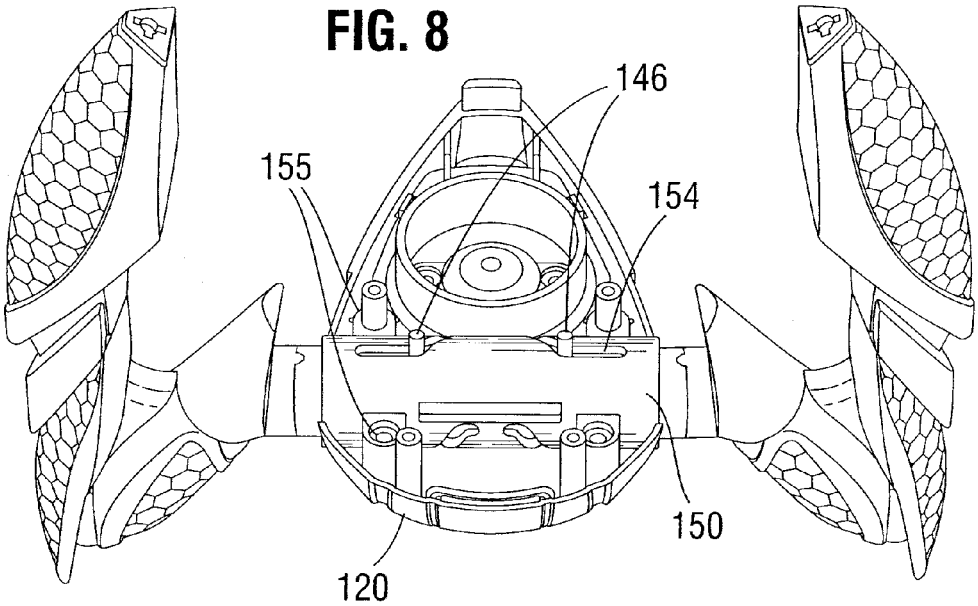
FIG. 8 is a rear perspective view of a carrier shaft and upper body portion of the toy projectile launcher of FIG. 2.
Figure 9:
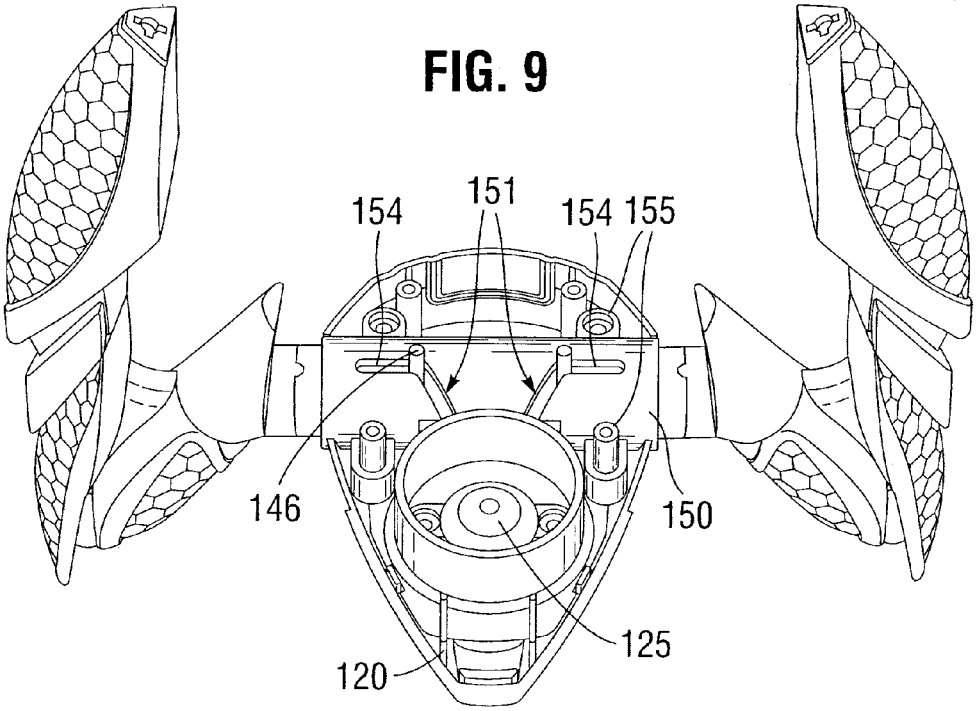
FIG. 9 is a front perspective view of a carrier shaft and upper body portion of the toy projectile launcher of FIG. 2.
Figure 10:
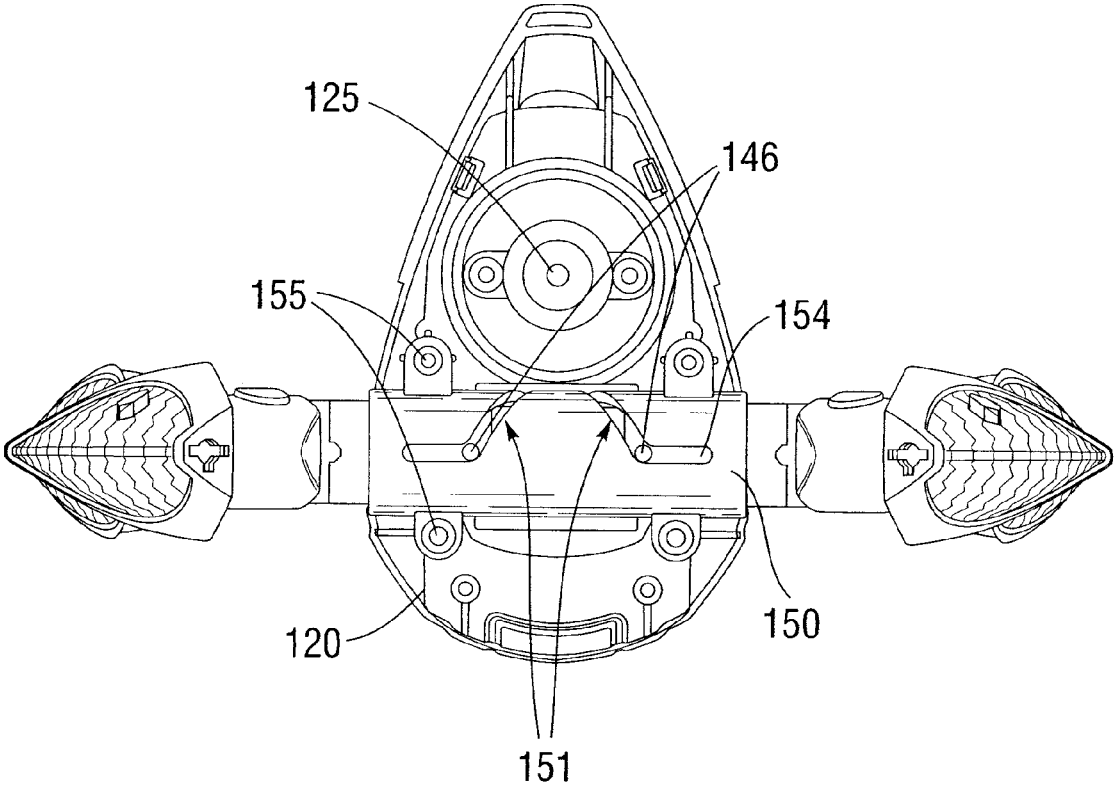
FIG. 10 is a bottom view of a carrier shaft and upper body portion of the toy projectile launcher of FIG. 2.

As shown in the rear perspective view of upper body portion 120 of FIG. 8, the front perspective view of upper body portion 120 of FIG. 9, and the bottom view of upper body portion 120 of FIG. 10, carrier shaft 150 can be affixed to or integrally formed with the main body. The carrier shaft 150 can be affixed either to the main body 118 at its upper body portion 120, the lower body portion 130, or both. In the embodiments depicted in the figures, the carrier shaft 150 is affixed to the upper body portion 120 at connector hubs 155, which may receive threaded connectors (such as screws, bolts, or the like) to rigidly affix carrier shaft 150 to upper body portion 120. Thus, and as mentioned above, as guide pins 146 move outwardly through guide channels 151 so as to cause carrier shaft 150 to rotate, main body 118 likewise rotates with carrier shaft 150.

Figure 11:
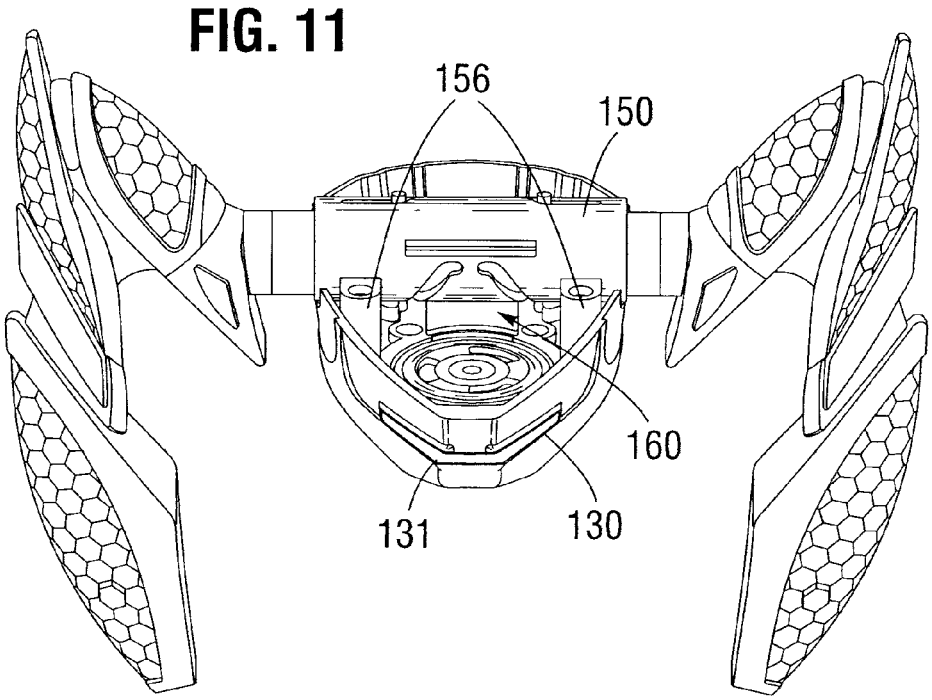
FIG. 11 is a front perspective view of a lower body portion of the toy projectile launcher of FIG. 2 in a launch position.
Figure 12:
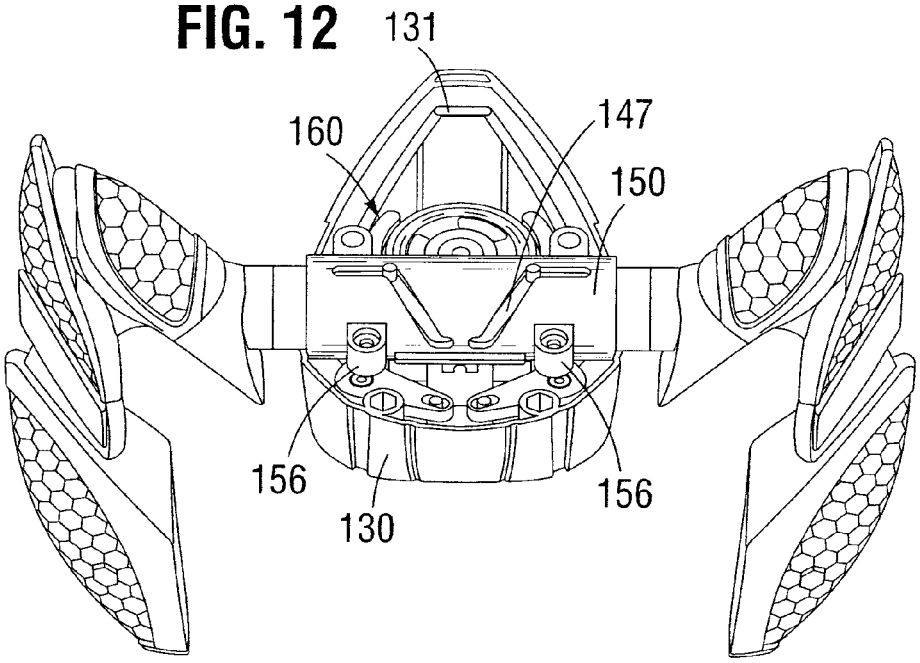
FIG. 12 is a rear perspective view of a lower body portion of the toy projectile launcher of FIG. 2 in a launch position.

Next, and with reference to the front perspective view of lower body portion 130 of FIG. 11 and the back perspective view of lower body portion 130 of FIG. 12, an internal launcher (shown generally at 160) can be mounted to lower body portion 130. The internal launcher 160 engages the guide pins 146 extending out of the lower portion of carrier shaft 150, which activate the internal launcher 160. As with upper body portion 120, carrier shaft 150 is affixed to lower body portion 130 at connector hubs 156, which may receive threaded connectors (such as screws, bolts, or the like) to rigidly affix carrier shaft 150 to lower body portion 130. Internal launcher 160 is preferably positioned below carrier shaft 150 (so as to engage guide pins 146 extending out of the lower portion of carrier shaft 150) and in alignment with launch opening 131 at the front end of lower body portion 130.

Figure 13:
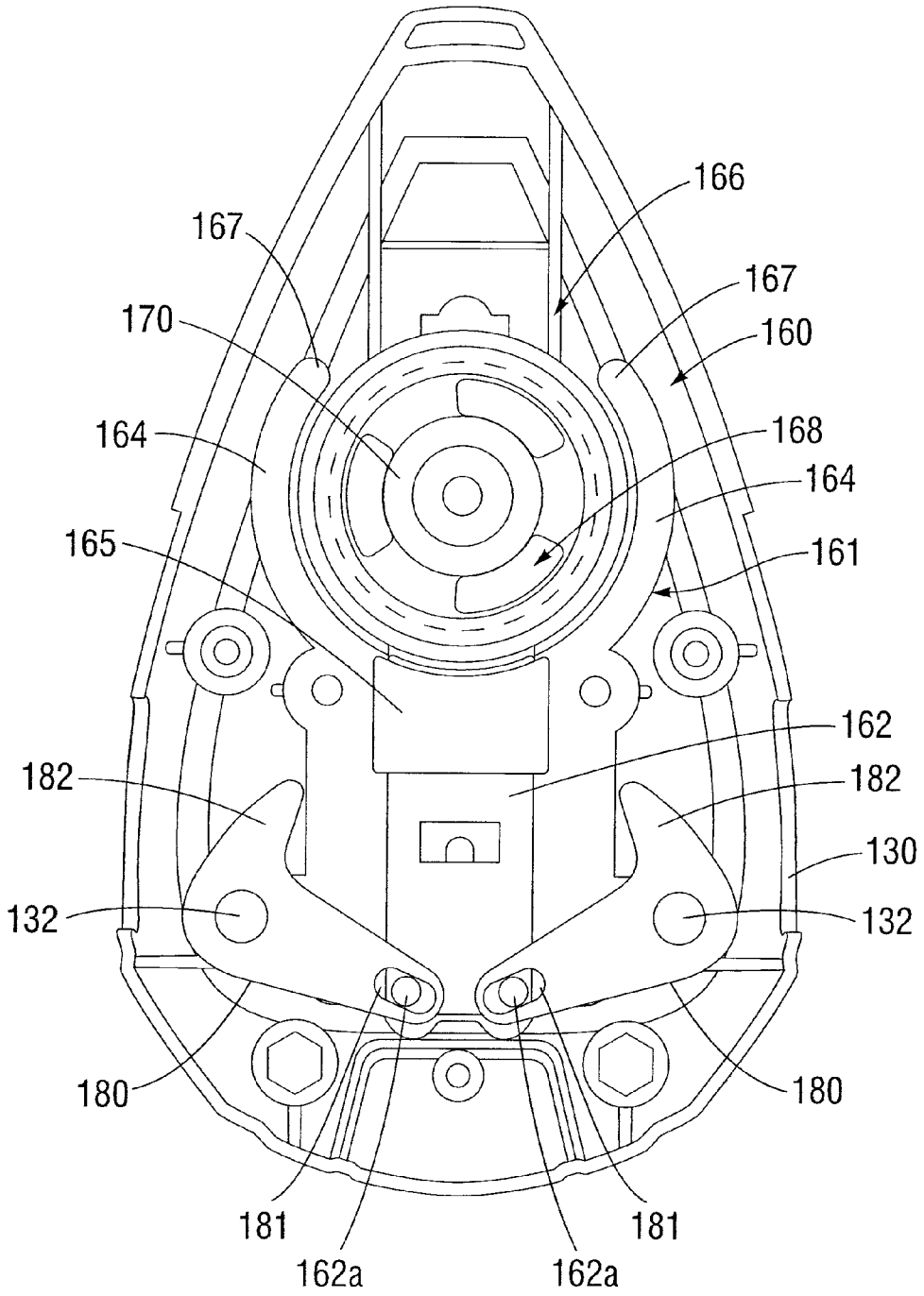
FIG. 13 is a top sectional view of an internal launcher for use with the toy projectile launcher of FIG. 2 in a loading position.

With continued reference to FIGS. 11 and 12 and the top view of internal launcher 160 of FIG. 13, internal launcher 160 includes a C-spring disc launcher 161 configured to receive and launch a flying disc 170, a disc pusher 162, and rocker arms 180 pivotably mounted to lower body portion 130 at pivot connection posts 132 and engaging disc pusher 162 to push a disc 170 through C-spring disc launcher 161. The C-spring disc launcher 161 comprises curved resilient arms 164, a mounting plate 165 joining curved resilient arms 164, and an opening 166 defined by the distal ends 167 of curved resilient arms 164.

In the illustrated embodiments, opening 166 is smaller than the diameter of flying disc 170 such that disc 170 must be forced through opening 166 to pass there through. Curved resilient arms 164 define an interior 168 of C-spring disc launcher 161 in which flying disc 170 may be placed.

In some embodiments, curved resilient arms 164 include a spin member for imparting spin to flying disc 170. Spin member may reside at a distal end 167 of one of curved resilient arms 164. In some embodiments, spin member may include a projection projecting into interior 168 of C-spring disc launcher 161. In other embodiments, spin member 169 may be an extension of the distal end of one of curved resilient arms 164, such that one curved resilient arm 164 is longer than the other. Flying disc 170 may include teeth extending around the outer perimeter of flying disc 170 for engaging with the spin member.

As illustrated, disc pusher 162 is slidably mounted and configured to slide between a loading position and a firing position. In the loading position (as shown in FIG. 13), disc pusher 162 is disposed outside of the interior 168 of C-spring disc launcher 161 to facilitate the loading of flying disc 170 into the interior space 168. In the firing position, depicted in the bottom perspective view of internal launcher 160 of FIG. 14, disc pusher 162 projects into C-spring disc launcher 161, after having begun pushing flying disc 170 through opening 166 and through launch opening 131 of lower body portion 130.

In some embodiments, mounting plate 165 of internal launcher 160 may include a groove **165*a* (shown in the exploded view of toy disc launcher 100 of FIG. 17) through which disc pusher 162 may slide into the interior 168 of C-spring disc launcher 161. Groove 165*a* may form a channel defining a path in which disc pusher 162** may slide.

As disc pusher 162 pushes flying disc 170 through opening 166, curved resilient arms 164 may expand and store potential energy therein. When disc pusher 162 moves flying disc 170 more than approximately 50% through opening 166, curved resilient arms 164 may retract and transfer the potential energy stored therein to flying disc 170. The potential energy transferred to flying disc 170 may convert to kinetic energy and cause flying disc 170 to shoot out of toy disc launcher 100 through launch opening 131 in lower body portion 130.

In order to slide disc pusher 162 into opening 166 to launch flying discs 170, and to likewise retract disc pusher 162 to load an additional flying disc 170 into opening 166, rocker arms 180 pivot about pivot pins 132. Rocker arms 180 each have a post receiver 181 that receives a post **162*a* attached to and extending upward from the top of disc pusher 162. Rocker arms 180 also each have hook portions 182, each hook portion 182 having an internal face positioned to engage guide pin 146 extending from the bottom side of carrier shaft 150**.

Figure 14:
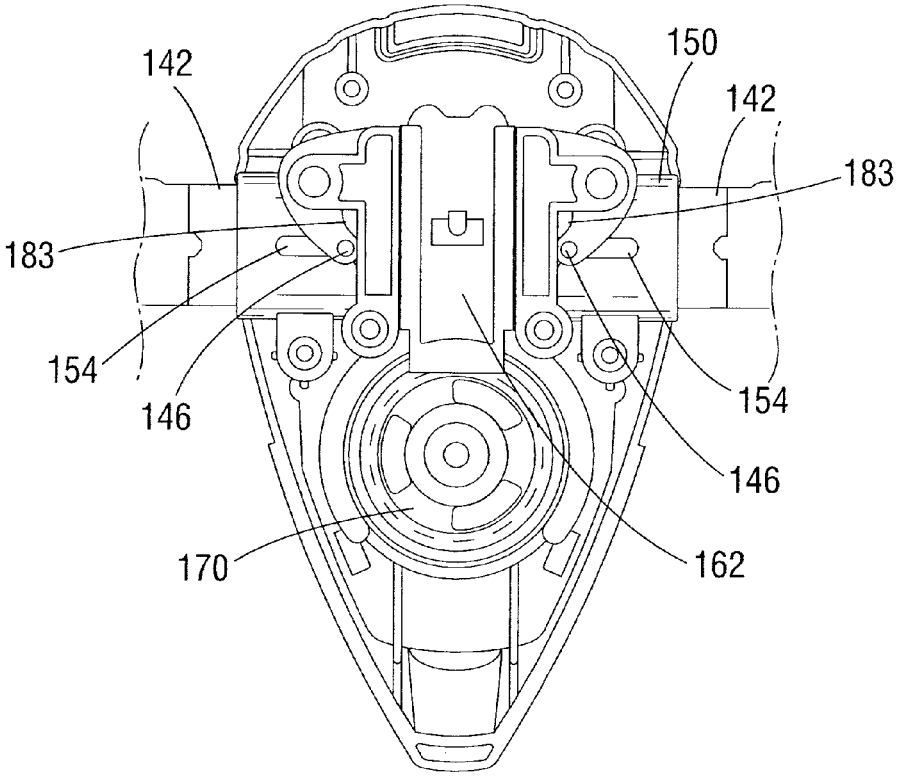
FIG. 14 is a bottom sectional view of the internal launcher of FIG. 13 in a firing position.
Figure 15:
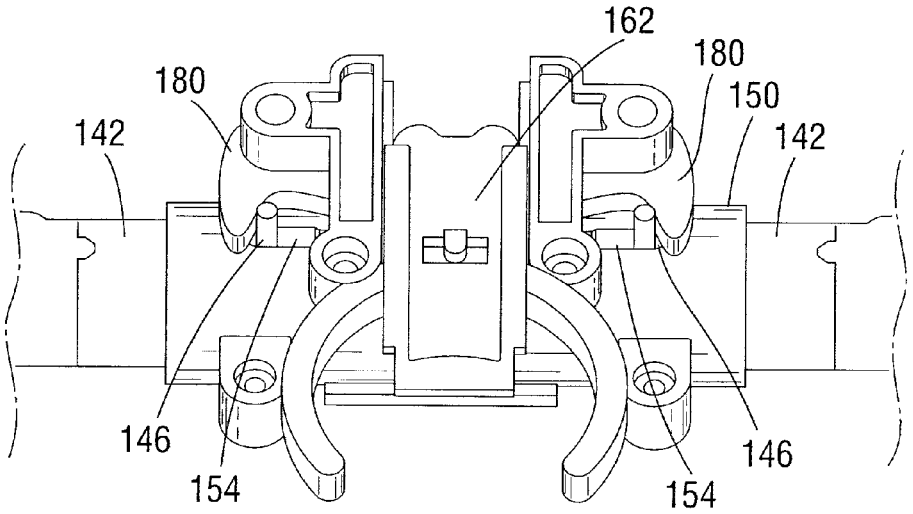
FIG. 15 is a close-up sectional view of the internal launcher of FIG. 13.

As shown in the bottom view of internal launcher 160 of FIG. 14 (mounting plate 165 not shown for clarity), as guide pins 146 extending from the bottom of drive shafts 142 move through angled portion 153 of guide channels 151 and toward to the start of outer axial portion 154, those guide pins 146 do not engage the internal faces 183 of hook portions 182 of rocker arms 180 until the guide pins reach outer axial portion 154. Once the guide pins reach outer axial portion 154 of guide channels 151, further outer movement of guide pins 146 along outer axial portion 154 of guide channels 151 push internal faces 183 of rocker arms 180 outwardly. In other embodiments, the guide pins 146 feed into openings in a lower surface of the rocker arms 180, such that any movement of the guide pins 146 directly translate into movement of the rocker arms 180. The pivoting of the rocker arms 180 from outward movement of the guide pins 146 moves post receivers 181 (FIG. 13) toward the front of toy disc launcher 100. As post receivers 181 move toward the front of toy disc launcher 100, they likewise push disc pusher 162 forward into a flying disc 170 so as to initiate the launch of flying disc 170 as discussed above. As arms 140 are thereafter pushed back toward the main body 118 of toy disc launcher 100, guide pins 146 likewise move toward the interior edge of outer axial portion 154 of guide channels 151, allowing rocker arms 180 to pivot back to their original position and, in turn, pull disc pusher 162 back to its retracted position to allow the next flying disc 170 to be loaded into the interior 168 of C-spring disc launcher 161. To facilitate the return of rocker arms 180 to such original positions, rocker anus may be biased by a spring member (not shown), although other mechanisms for returning rocker arms to their original positions will be apparent to those skilled in the art (e.g., by providing a rearward spring bias to disc pusher 162 to pull disc pusher 162 back to its original position).

Figure 16:
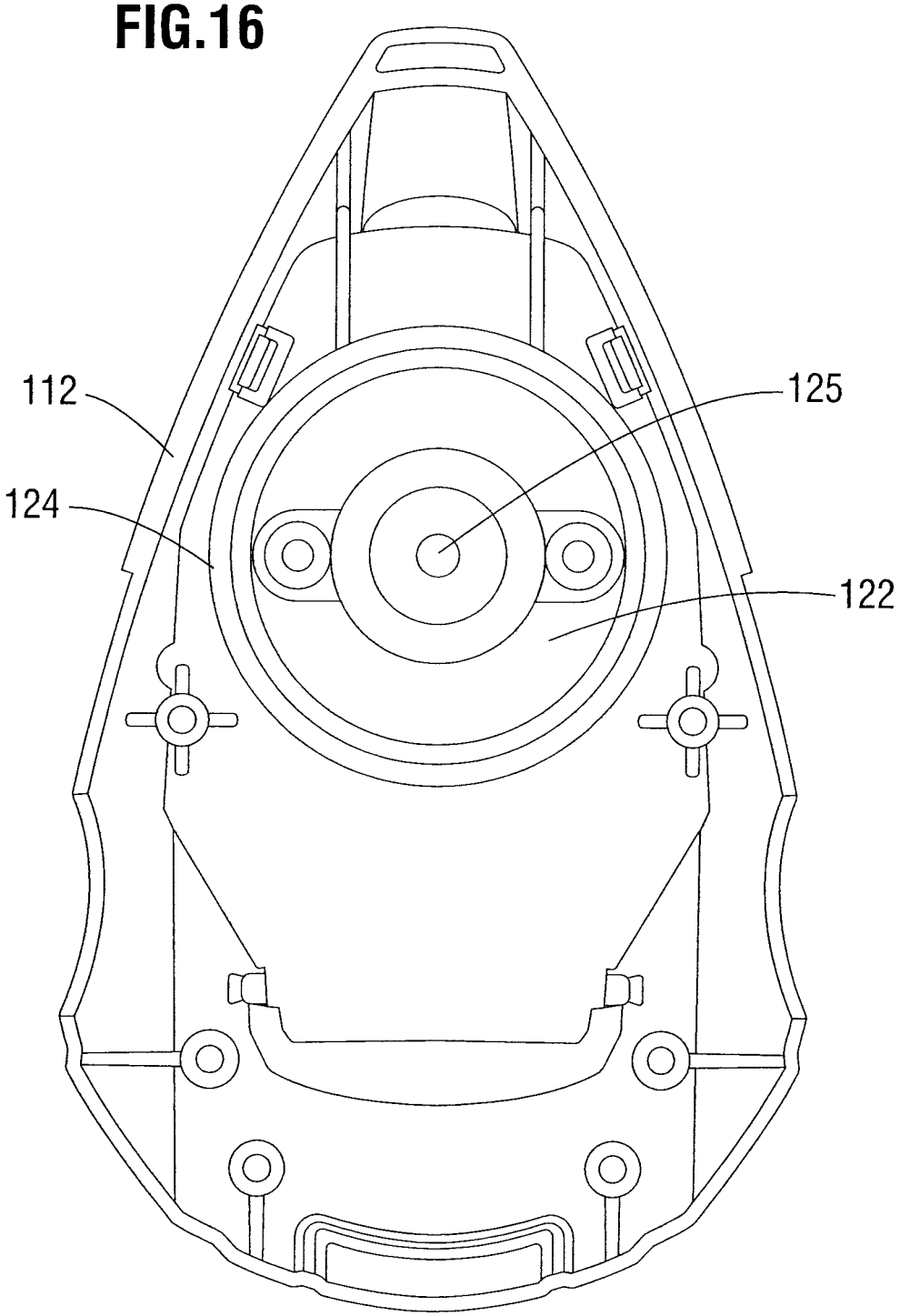
FIG. 16 is a bottom view of an upper body portion of the toy projectile launcher of FIG. 2.

In order to successively feed additional flying discs 170 from disc cartridge 124 into the interior 168 of C-spring disc launcher 161, and as mentioned briefly above, a downwardly spring-biased plunger 125 (shown in FIGS. 4 and 8 through 9 and in the bottom view of upper body portion 120 of FIG. 16) is positioned within cover hatch 122 of upper body portion 120, and is operative to maintain a downward force on a stack of flying discs 170 positioned within disc cartridge 124. Thus, as one flying disc 170 is launched from internal launcher 160, and disc pusher 162 returns to its original position, the lowest flying disc 170 in disc cartridge 124 is automatically pushed downward and into the interior 168 of C-spring disc launcher 161, and in turn is made ready for launch upon the next pull of arms 140 away from main body 118 of toy disc launcher 100.

Figure 17:
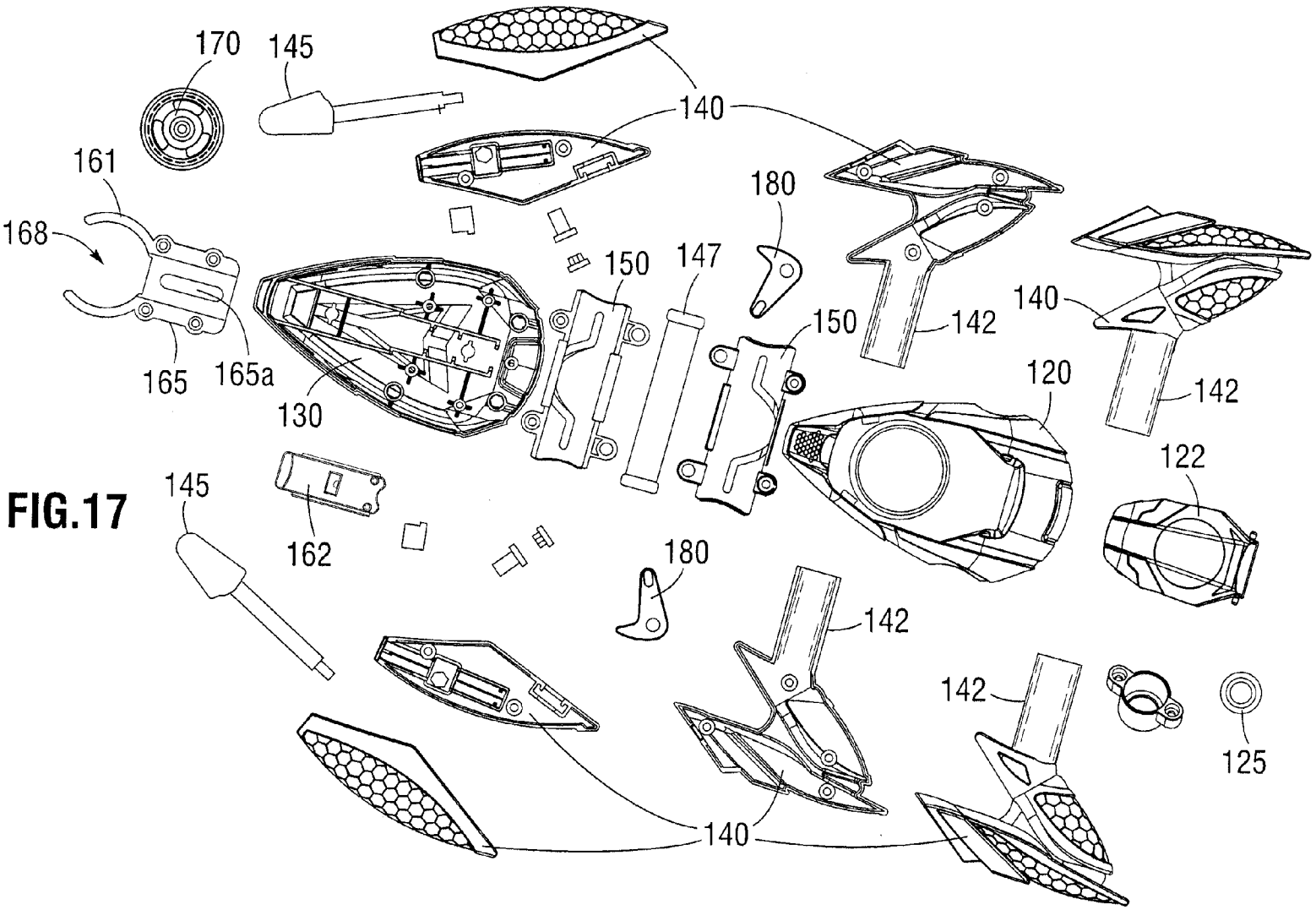
FIG. 17 is an exploded view of the toy projectile launcher of FIG. 2.

FIG. 17 provides an exploded view of various of the above-described components of toy disc launcher 100.

It is to be understood that the detailed description and specific examples, while indicating preferred embodiments of the present disclosure, are given by way of illustration and not limitation. Many changes and modifications within the scope of the present disclosure may be made without departing from the spirit thereof, and the disclosure includes all such modifications.

The invention claimed is:

1. A toy projectile launcher comprising:

a body; and a launch actuator extendable from and pivotably mounted to said body, said launch actuator operatively engaging a projectile launcher within said body;

wherein said toy projectile launcher is configured such that extending said launch actuator along an axis through said body causes pivoting of said body about said axis with respect to said launch actuator and activation of said projectile launcher to launch a projectile from said body.

2. The toy projectile launcher of claim 1, said body further comprising a projectile cartridge configured to receive a plurality of projectiles in said projectile cartridge, wherein the extending of said launch actuator causes one of said plurality of projectiles to be launched from said body.

3. The toy projectile launcher of claim 1, said launch actuator further comprising a first arm extendable from a first side of said body and a second arm extendable from a second side of said.

4. The toy projectile launcher of claim 3, further comprising a mechanical controller mechanically connecting said first arm and said second arm to said body and to said projectile launcher within said body, said mechanical controller further comprising:

a carrier shaft; and a drive mechanism attached to each of said first arm and said second arm and engaging said carrier shaft.

5. The toy projectile launcher of claim 4, wherein said first arm and said second arm are extendable from said body by a pull stroke of fixed length, wherein said mechanical controller is configured to translate a first portion of said pull stroke through said drive mechanism to said carrier shaft to pivot said body with respect to said first arm and said second arm.

6. The toy projectile launcher of claim 5, wherein said mechanical controller is further configured to translate a second portion of said pull stroke through said drive mechanism to said projectile launcher to launch a projectile from said body.

7. The toy projectile launcher of claim 6, wherein said mechanical controller is further configured to translate reversal of said second portion of said pull stroke through said drive mechanism to said projectile launcher to reset said projectile launcher for launching additional projectiles.

8. The toy projectile launcher of claim 4, wherein said drive mechanism further comprises a first drive shaft attached to said first arm and a second drive shaft attached to said second arm, and at least one guide pin attached to each of said first drive shaft and said second drive shaft.

9. The toy projectile launcher of claim 8, said carrier shaft further comprising a plurality of guide channels, each of said guide channels receiving one of said guide pins.

10. A toy projectile launcher comprising:

a body configured to receive a plurality of projectiles; and a launch actuator operatively engaging a projectile launcher within said body, said launch actuator further comprising a first arm extendable from a first side of said body and a second arm extendable from a second side of said body, wherein extending said first and second arms away from one another causes activation of said projectile launcher to launch a projectile from said body.

11. The toy projectile launcher of claim 10, wherein extending said first and second arms away from said body further causes said body to pivot with respect to said first and second arms.

12. The toy projectile launcher of claim 11, said body further comprising a projectile cartridge configured to receive a plurality of projectiles in said projectile cartridge such that activation of said launch actuator causes one of said plurality of projectiles to be launched from said body.

13. The toy projectile launcher of claim 11, further comprising a mechanical controller mechanically connecting said first arm and said second arm to said body and to said projectile launcher within said body, said mechanical controller further comprising:

a carrier shaft; and a drive mechanism attached to each of said first arm and said second arm and engaging said carrier shaft.

14. The toy projectile launcher of claim 13, wherein said first arm and said second arm are extendable from said body by a pull stroke of fixed length, wherein said mechanical controller is configured to translate a first portion of said pull stroke through said drive mechanism to said carrier shaft to pivot said body with respect to said first arm and said second arm.

15. The toy projectile launcher of claim 14, wherein said mechanical controller is further configured to translate a second portion of said pull stroke through said drive mechanism to said projectile launcher to launch a projectile from said body.

16. The toy projectile launcher of claim 15, wherein said mechanical controller is further configured to translate reversal of said second portion of said pull stroke through said drive mechanism to said projectile launcher to reset said projectile launcher for launching additional projectiles.

17. The toy projectile launcher of claim 13, wherein said drive mechanism further comprises a first drive shaft attached to said first arm and a second drive shaft attached to said second arm, and at least one guide pin attached to each of said first drive shaft and said second drive shaft.

18. The toy projectile launcher of claim 17, said carrier shaft further comprising a plurality of guide channels, each of said guide channels receiving one of said guide pins.

19. A toy projectile launcher comprising:

a body comprising a projectile launcher and a carrier shaft; and a drive shaft movably disposed within the carrier shaft, the drive shaft comprising guide pins engaging the carrier shaft such that axial movement of the drive shaft in a first direction relative to the carrier shaft causes guide pins to traverse one or both of an arc length and an axial length of the carrier shaft;

wherein when the guide pins traverse the arc length of the carrier shaft, the guide pins cause the body to rotate a predetermined angle relative to the drive shaft from a first position to a second position; and wherein when the guide pins traverse the axial length of the carrier shaft with the body in the second position, the guide pins activate the projectile launcher.

20. The toy projectile launcher of claim 19, wherein the drive shaft comprises two portions and wherein the axial movement of the drive shaft in the first direction entails moving the two portions in opposing directions away from one another.

* * * * *